US006946227B2

(12) United States Patent
Lin et al.

(10) Patent No.: US 6,946,227 B2
(45) Date of Patent: Sep. 20, 2005

(54) IMAGING MEMBERS

(75) Inventors: Liang-Bih Lin, Webster, NY (US); Richard H. Nealey, Plymouth, MA (US); Ah-Mee Hor, Mississauga (CA); James M. Duff, Mississauga (CA); Timothy P. Bender, Port Credit (CA); Andrew R. Melnyk, Rochester, NY (US); Andronique Ioannidis, Webster, NY (US); Harold F. Hammond, Rochester, NY (US); Linda L. Ferrarese, Rochester, NY (US); Cindy C. Chen, Rochester, NY (US); James M. Markovics, Rochester, NY (US); Kenny-Tuan T. Dinh, Webster, NY (US)

(73) Assignee: Xerox Corporation, Stamford, CT (US)

( * ) Notice: Subject to any disclaimer, the term of this patent is extended or adjusted under 35 U.S.C. 154(b) by 3 days.

(21) Appl. No.: 10/300,643

(22) Filed: Nov. 20, 2002

(65) Prior Publication Data

US 2004/0096761 A1 May 20, 2004

(51) Int. Cl.[7] ..... G03G 5/06
(52) U.S. Cl. ..... 430/72; 430/75; 430/78
(58) Field of Search ..... 430/78, 75, 72, 430/59.5, 59.4, 58.15, 58.25, 58.5, 58.8, 96

(56) References Cited

U.S. PATENT DOCUMENTS

| | | | | | |
|---|---|---|---|---|---|
| 3,121,006 | A | | 2/1964 | Middleton et al. | |
| 4,265,990 | A | | 5/1981 | Stolka et al. | 430/59 |
| 4,295,990 | A | | 10/1981 | Verbeek et al. | 252/408 |
| 4,298,697 | A | | 11/1981 | Baczek et al. | 521/27 |
| 4,338,390 | A | | 7/1982 | Lu | 430/106 |
| 4,474,865 | A | | 10/1984 | Ong et al. | 430/58 |
| 4,560,635 | A | | 12/1985 | Hoffend et al. | 430/106.6 |
| 4,587,189 | A | | 5/1986 | Hor et al. | 430/59 |
| 5,252,417 | A | | 10/1993 | Tokida et al. | 430/59 |
| 5,288,574 | A | * | 2/1994 | Desilets et al. | 430/78 |
| 5,336,577 | A | | 8/1994 | Spiewak et al. | 430/59 |
| 5,578,406 | A | * | 11/1996 | Ojima et al. | 430/83 |
| 5,994,012 | A | * | 11/1999 | Watanabe et al. | 430/83 |
| 6,232,466 | B1 | | 5/2001 | Daimon et al. | 540/141 |
| 6,268,096 | B1 | | 7/2001 | Nukada et al. | 430/78 |
| 6,432,595 | B1 | * | 8/2002 | Kawaguchi et al. | 430/56 |
| 6,586,148 | B1 | * | 7/2003 | Graham et al. | 430/58.65 |
| 2003/0211413 | A1 | * | 11/2003 | Lin et al. | 430/78 |
| 2004/0086796 | A1 | * | 5/2004 | Yu et al. | 430/56 |

FOREIGN PATENT DOCUMENTS

| | | | | | |
|---|---|---|---|---|---|
| EP | 638848 | A1 | * | 2/1995 | |
| JP | 2000019758 | A | * | 1/2000 | G03G/5/06 |
| JP | 2002055472 | A | * | 2/2002 | G03G/5/06 |

* cited by examiner

*Primary Examiner*—Christopher Rodee
(74) *Attorney, Agent, or Firm*—Oliff & Berridge PLC

(57) ABSTRACT

A photoconductive imaging member containers of a supporting substrate, and thereover a single layer comprised of a mixture of a photogenerator component, a charge transport component, an electron transport component, and a polymer binder, and wherein the photogenerating component is a pigment.

19 Claims, No Drawings

IMAGING MEMBERS

RELATED PATENT APPLICATIONS

Illustrated in copending application U.S. Ser. No. 09/302,524, now abandoned, the disclosure of which is totally incorporated herein by reference, is, for example, an ambipolar photoconductive imaging member comprised of a supporting substrate, and thereover a layer comprised of a photogenerator hydroxygallium component, a charge transport component, and an electron transport component.

U.S. patent application Ser. No. 09/627,283, now abandoned, filed in the names of Lin, et al on Jul. 28, 2000, discloses an imaging member having a single electrophotographic layer.

Illustrated in copending application U.S. Ser. No. 09/627,283, the disclosure of which is totally incorporated herein by reference, is, for example, an imaging member comprising a supporting layer and an electrophotographic photoconductive insulating layer, the electrophotographic photoconductive insulating layer comprising particles comprising Type V hydroxygallium phthalocyanine dispersed in a matrix comprising an arylamine hole transporter, and an electron transporter selected from the group consisting of a carboxlfluorenone malonitrile (CFM) derivatives represented by:

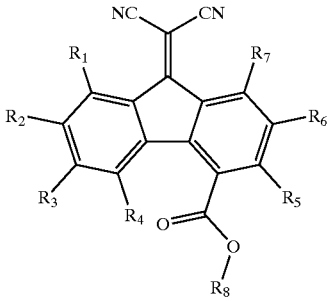

wherein each R is independently selected from the group consisting of hydrogen, alkyl having 1 to 40 carbon atoms, alkoxy having 1 to 40 carbon atoms, phenyl, substituted phenyl, higher aromatic such as naphthalene and antracene, alkylphenyl having 6 to 40 carbons, alkoxyphenyl having 6 to 40 carbons, aryl having 6 to 30 carbons, substituted aryl having 6 to 30 carbons and halogen, a nitrated fluoreneone derivative represented by:

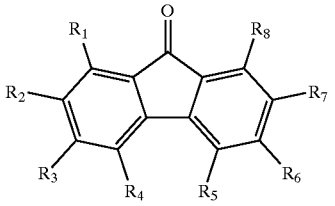

wherein each R is independently selected from the group consisting of hydrogen, alkyl having 1 to 40 carbon atoms, alkoxy having 1 to 40 carbon atoms, phenyl, substituted phenyl, higher aromatic such as naphthalene and antracene, alkylphenyl having 6 to 40 carbons, alkoxyphenyl having 6 to 40 carbons, aryl having 6 to 30 carbons, substituted aryl having 6 to 30 carbons and halogen, and at least 2 R groups are chosen to be nitro groups, a N,N'bis(dialkyl)-1,4,5,8-naphthalenetetracarboxylic diimide derivative or N,N'bis(diaryl)-1,4,5,8-naphthalenetetracarboxylic diimide derivative represented by:

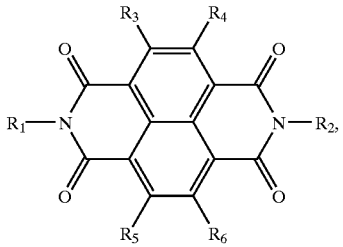

wherein R1 is substituted or unsubstituted alkyl, branched alkyl, cycloalkyl, alkoxy or aryl, such as phenyl, naphthyl, or a higher polycyclic aromatic such as anthracene R2 is alkyl, branched alkyl, cycloalkyl, or aryl, such as phenyl, naphthyl, or a higher polycyclic aromatic such as anthracene or the same as R1; R1 and R2 can be chosen independently to have total carbon number between 1 and 50 but is preferred to be between 1 and 12. R3, R4, R5 and R6 are alkyl, branched alkyl, cycloalkyl, alkoxy or aryl, such as phenyl, naphthyl, or a higher polycyclic aromatic such as anthracene or halogen and the like. R3, R4, R5 and R6 can be the same or different. In the case were R3, R4, R5 and R6 are carbon, they can be chosen independently to have a total carbon number between 1 and 50 but is preferred to be between 1 and 12, a 1,1'-dioxo-2-(aryl)-6-phenyl-4-(dicyanomethylidene) thiopyran derivative represented by:

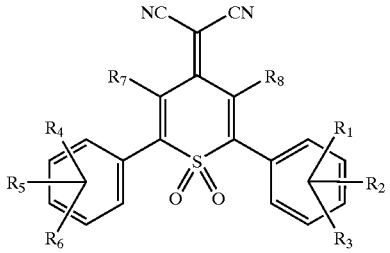

wherein each R is independently selected from the group consisting of hydrogen, alkyl having 1 to 40 carbon atoms, alkoxy having 1 to 40 carbon atoms, phenyl, substituted phenyl, higher aromatic such as naphthalene and antracene, alkylphenyl having 6 to 40 carbons, alkoxyphenyl having 6 to 40 carbons, aryl having 6 to 30 carbons, substituted aryl having 6 to 30 carbons and halogen, a carboxybenzylnaphthaquinone derivative represented by:

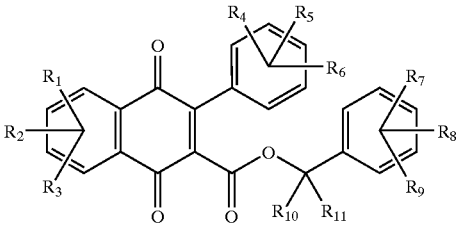

and/or

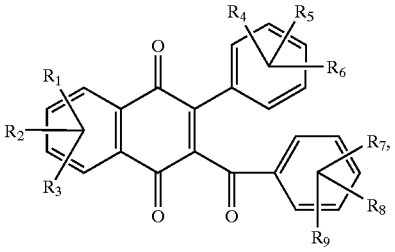

wherein each R is independently selected from the group consisting of hydrogen, alkyl having 1 to 40 carbon atoms, alkoxy having 1 to 40 carbon atoms, phenyl, substituted phenyl, higher aromatic such as naphthalene and antracene, alkylphenyl having 6 to 40 carbons, alkoxyphenyl having 6 to 40 carbons, aryl having 6 to 30 carbons, substituted aryl having 6 to 30 carbons and halogen, or a diphenoquinone represented by:

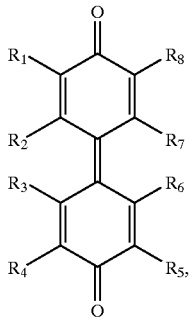

and mixtures thereof, wherein each R is independently selected from the group consisting of hydrogen, alkyl having 1 to 40 carbon atoms, alkoxy having 1 to 40 carbon atoms, phenyl, substituted phenyl, higher aromatic such as naphthalene and antracene, alkylphenyl having 6 to 40 carbons, alkoxyphenyl having 6 to 40 carbons, aryl having 6 to 30 carbons, substituted aryl having 6 to 30 carbons and halogen, a film forming binder.

The appropriate components and processes of the above copending applications may be selected for the invention of the present application in embodiments thereof.

BACKGROUND

This invention relates in general to electrophotographic imaging members and, more specifically, to positively and negatively charged electrophotographic imaging members having a single electrophotographic photoconductive insulating layer and processes for forming images on the member. More specifically, the present invention relates to a singled layered photoconductive imaging member containing a charge generation layer or photogenerating layer comprised of a Type IV titanylphthalocyanine (TiOPC(IV)) component dispersed in a matrix of a hole transporting and an electron transporting binder. The electrophotographic imaging member layer components, which can be dispersed in various suitable resin binders, can be of various thickness, however, in embodiments, a thick layer, such as from about 5 to about 60, and more specifically from about 10 to about 40 microns, is selected. This layer can be considered a dual function layer since it can generate charge and transport charge over a wide distance, such as a distance of at least about 50 microns. Also, the presence of the electron transport components in the photogenerating layer can enhance electron mobility and thus enable a thicker photogenerating layer, and which thick layers can be more easily coated than a thin layer, for example, from about 1 to 2 microns thick.

A number of electrophotographic imaging members are multi-layered imaging members comprising a substrate and a plurality of other layers, such as, a charge generating layer and a charge transport layer. These commercial multi-layered imaging members also often contain a charge blocking layer and an adhesive layer between the substrate and the charge generating layer. Further, an anti-plywooding layer may be needed. This anti-plywooding layer can be a separate layer or be part of a dual function layer. An example of a dual function layer for preventing plywooding is a charge blocking layer or an adhesive layer which also prevents plywooding. The expression "plywooding", as employed herein, refers in embodiments to the formation of unwanted patterns in electrostatic latent images caused by multiple reflections during laser exposure of a charged imaging member. When developed, these patterns resemble plywood. These multi-layered imaging members are also costly and time consuming to fabricate because of the many layers that must be formed. Further, complex equipment and valuable factory floor space are required to manufacture these multi-layered imaging members. In addition to presenting plywooding problems, the multi-layered imaging members often encounter charge spreading which degrades image resolution.

One problem encountered with multilayered photoreceptors comprising a charge generating layer and a charge transport layer is that the thickness of the charge transport layer, which is normally the outermost layer, tends to become thinner due to wear during image cycling. The change in thickness causes changes in the photoelectrical properties of the photoreceptor. Thus, to maintain image quality, complex and sophisticated electronic equipment and software management are usually necessary in the imaging machine to compensate for the photoelectrical changes, which can increase the complexity of the machine, cost of the machine, size of the footprint occupied by the machine, and the like. Without proper compensation of the changing electrical properties of the photoreceptor during cycling, the quality of the images formed can degrade because of spreading of the charge pattern on the surface of the imaging member and a decline in image resolution. High quality images can be important for digital copiers, duplicators, printers, and facsimile machines, particularly laser exposure machines that demand high resolution images. Moreover, the use of lasers to expose conventional multilayered photoreceptors can lead to the formation of undesirable plywood patterns that are visible in the final images.

Attempts have been made to fabricate electrophotographic imaging members comprising a substrate and a single electrophotographic photoconductive insulating layer in place of a plurality of layers such as a charge generating layer and a charge transport layer. However, in formulating single electrophotographic photoconductive insulating layer photoreceptors many problems need to be overcome including charge acceptance for hole and/or electron transporting materials from photoelectroactive pigments. In addition to electrical compatibility and performance, a material mix for forming a single layer photoreceptor should possess the proper rheology and resistance to agglomeration to enable acceptable coatings. Also, compatibility among pigment, hole, electron transport molecules, and film forming binder is desirable. As utilized herein, the expression "single electrophotographic photoconductive insulating layer" refers in embodiments to a single electrophotographically active photogenerating layer capable of retaining an electrostatic charge in the dark during electrostatic charging, imagewise exposure and image development. Thus, unlike a single electrophotographic photoconductive insulating layer photoreceptor, a multi-layered photoreceptor has at least two electrophotographically active layers, for example at least one charge generating layer and at least one separate charge transport layer.

REFERENCES

U.S. Pat. No. 4,265,990 discloses a photosensitive member having at least two electrically operative layers. The first layer comprises a photoconductive layer which is capable of photogenerating holes and injecting photogenerated holes into a contiguous charge transport layer. The charge transport layer comprises a polycarbonate resin containing from about 25 to about 75 percent by weight of one or more of a compound having a specified general formula. This structure may be imaged in the conventional xerographic mode which usually includes; charging, exposure to light, and development.

U.S. Pat. No. 5,336,577 discloses a thick organic ambipolar layer on a photoresponsive device is simultaneously capable of charge generation and charge transport. In particular, the organic photoresponsive layer contains an electron transport material such as a fluorenylidene malonitrile derivative and a hole transport material such as a dihydroxy tetraphenyl benzadine containing polymer. These may be complexed to provide photoresponsivity, and/or a photoresponsive pigment or dye may also be included.

U.S. Pat. No. 6,268,096 discloses a titanyl phthalocyanine crystal, a photo conductive material comprising the same, and an electrophotographic photoreceptor using the same. In particular, the titanyl phthalocyanine crystal comprises a primary particle diameter ranging from about 0.03 to about 0.15 $\mu$m, showing a maximum X-ray diffraction peak at a Bragg angle (20±0.2°) of 27.3°, having an ellipsoidal tabular form, and having a BET specific surface area of not less than 35 $m^2/g$.

U.S. Pat. No. 6,232,466 discloses a process for preparing a stable titanyl phthalocyanine crystal showing at least one diffraction peak at a Bragg angle (20±0.2°) of 27.3°, which comprises treating amorphous or quasi-amorphous titanyl phthalocyanine with a solvent selected from an alcohol solvent, an aromatic solvent, a mixed solvent, or a mixed solvent of an alcohol solvent and water. The resulting titanyl phthalocyanine exhibits high photosensitivity and excellent durability as a photoconductive material of an electrophotographic photoreceptor.

The entire disclosures of these patents are incorporated herein by reference.

SUMMARY

Disclosed is an electrophotographic imaging member comprising a single electrophotographic photoconductive insulating layer that avoids plywooding problems, and which layer contains a photogenerating pigment, an electron transport component, a hole transport component, and a filming forming binder.

Also disclosed is an improved electrophotographic imaging member comprising a single electrophotographic photoconductive insulating layer that eliminates the need for a charge blocking layer between a supporting substrate and an electrophotographic photoconductive insulating layer, and wherein the photogenerating mixture layer can be of a thickness of, for example, from about 5 to about 60 microns, and thereover as the top layer a charge transporting layer, and which members possess excellent high photosensitivities, acceptable discharge characteristics, and further which members are visible and infrared laser compatible.

Further disclosed is an electrophotographic imaging member comprising a single electrophotographic photoconductive insulating layer, which can be fabricated with fewer coating steps at reduced cost, which eliminates charge spreading, therefore, enabling higher resolution, and which members are not substantially susceptible to plywooding effects, a light refraction problem, and thus with the photoconductive imaging members of the present invention in embodiments thereof an undercoated separate layer is avoided.

Also disclosed is an improved electrophotographic imaging member comprising a single electrophotographic photoconductive insulating layer which has improved cycling and stability, and which members possess high resolution since, for example, the image forming charge packet does not need to traverse the entire thickness of the member and thus does not spread in area, and further with such singled layered members there is enabled in embodiments extended life high resolution members since, for example, the layer can be present in a thicker layer, such as from about 5 to about 60 microns, as compared to a number of multilayered devices wherein the thickness of the photogenerator layer is usually from about 1 to about 3 microns in thickness, thus with the aforementioned invention devices there is substantially no image resolution loss and substantially no image resolution loss with wear, for which photo induced discharge curves do not substantially change with time or repeated use, and also wherein with these photoreceptors charge injections from the substrate to the photogenerating pigment is reduced and thus a charge blocking layer can be avoided.

Further disclosed is an improved electrophotographic imaging member comprising a single electrophotographic photoconductive insulating layer which is ambipolar and can be operated at either positive or negative biases.

The present invention in embodiments thereof is directed to a photoconductive imaging member comprised of a supporting substrate, a single layer thereover comprised of a mixture of a photogenerating pigment or pigments, a hole transport component or components, an electron transport component or components, and a film forming binder. More specifically, the present invention relates to an imaging member, such as for example, from about 5 to about 60 microns, with a thick single active layer comprised of a mixture of photogenerating pigments, hole transport molecules, electron transport compounds, and a filming binder.

Aspects of the present invention are directed to a photoconductive imaging member comprised in sequence of a substrate, a single electrophotographic photoconductive insulating layer, the electrophotographic photoconductive insulating layer comprising photogenerating particles comprising photogenerating pigments, such as titanyl phthalocyanine (TiOPC(IV))s, dispersed in a matrix comprising a hole transport molecule such as, for example, those selected from the group consisting of an arylamine and a hydrazone, and an electron transport material, for example, selected from the group consisting of N,N'-bis(1,2-dimethylpropyl)-1,4,5,8-naphthalenetetracarboxylic diimide represented by:

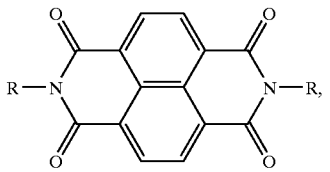

1,1'-dioxo-2-(4-methylphenyl)-6-phenyl-4-(dicyanomethylidene)thiopyran represented by:

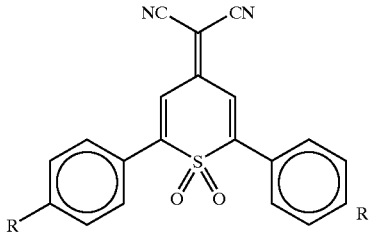

wherein each R is independently selected from the group consisting of hydrogen, alkyl having from about 1 to about 4 carbon atoms, alkoxy having from about 1 to about 4 carbon atoms and halogen, and an optional quinone selected, for example, from the group consisting of carboxybenzylnaphthaquinone represented by:

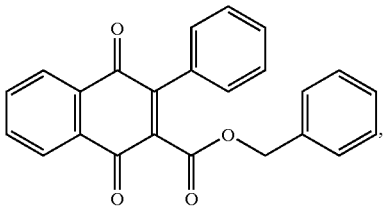

and tetra(t-butyl)diphenolquinone, and a film forming binder.

This imaging member may be imaged by depositing a uniform electrostatic charge on the imaging member, exposing the imaging member to activating radiation in image configuration to form an electrostatic latent image, and developing the latent image with electrostatically attractable marking particles to form a toner image in conformance to the latent image.

Any suitable substrate may be employed in the imaging member of this invention. The substrate may be opaque or substantially transparent, and may comprise any suitable material having the requisite mechanical properties. Thus, for example, the substrate may comprise a layer of insulating material including inorganic or organic polymeric materials, such as MYLAR® a commercially available polymer, MYLAR® coated titanium, a layer of an organic or inorganic material having a semiconductive surface layer, such as indium tin oxide, aluminum, titanium, and the like, or exclusively be comprised of a conductive material such as aluminum, chromium, nickel, brass, and the like. The substrate may be flexible, seamless or rigid and may have a number of many different configurations, such as, for example, a plate, a drum, a scroll, an endless flexible belt, and the like. In one embodiment, the substrate is in the form of a seamless flexible belt. The back of the substrate, particularly when the substrate is a flexible organic polymeric material, may optionally be coated with a conventional anticurl layer. Examples of substrate layers selected for the imaging members of the present invention can be as indicated herein, such as an opaque or substantially transparent material, and may comprise any suitable material having the requisite mechanical properties. Thus, the substrate may comprise a layer of insulating material including inorganic or organic polymeric materials, such as MYLAR® a commercially available polymer, MYLAR® containing titanium, or other suitable metal, a layer of an organic or inorganic material having a semiconductive surface layer, such as indium tin oxide, or aluminum arranged thereon, or a conductive material inclusive of aluminum, chromium, nickel, brass, or the like. The thickness of the substrate layer as indicated herein depends on many factors, including economical considerations, thus this layer may be of substantial thickness, for example, over 3,000 microns, or of a minimum thickness. In one embodiment, the thickness of this layer is from about 75 microns to about 300 microns.

Generally, the thickness of the single layer in contact with the supporting substrate depends on a number of factors, including the thickness of the substrate, the amount of components contained in the single layer, and the like. Accordingly, the layer can be of a thickness of, for example, from about 3 microns to about 60 microns, and more specifically, from about 5 microns to about 30 microns. The maximum thickness of the layer in an embodiment is dependent primarily upon factors, such as, photosensitivity, electrical properties, and mechanical considerations.

The binder resin present in various suitable amounts, for example, from about 5 to about 70, and more specifically, from about 10 to about 50 weight percent, may be selected from a number of known polymers such as, poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. In embodiments of the present invention, it is desirable to select the single layer coating solvents, such as, ketones, alcohols, aromatic hydrocarbons, halogenated aliphatic hydrocarbons, ethers, amines, amides, esters, and the like. Specific binder examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

An optional adhesive layer may be formed on the substrate. Typical materials employed in an undercoat adhesive layer include, for example, polyesters, polyamides, poly (vinyl butyral), poly(vinyl alcohol), polyurethane and polyacrylonitrile, and the like. Typical polyesters include, for example, VITEL® PE100 and PE200 available from Goodyear Chemicals, and MOR-ESTER 49,000® available from Norton International. The undercoat layer may have any suitable thickness, for example, of from about 0.001 micrometer to about 10 micrometers. A thickness of from about 0.1 micrometers to about 3 micrometers can be desirable. Optionally, the undercoat layer may contain suitable amounts of additives, for example, of from about 1 weight percent to about 10 weight percent, of conductive or nonconductive particles, such as, zinc oxide, titanium dioxide, silicon nitride, carbon black, and the like, to enhance, for example, electrical and optical properties. The undercoat layer can be coated on to a supporting substrate from a suitable solvent. Typical solvents include, for example, tetrahydrofuran, dichloromethane, and the like, and mixtures thereof.

Aspects of the present invention relate to a photoconductive imaging member comprised of supporting substrate, and thereover a layer comprised of a mixture of a titanyl phthalocyanine (TiOPC(IV)) photogenerator pigment, a hole transport component, and an electron transport component; a member wherein the single layer is of a thickness of from about 5 to about 60 microns; a member wherein the amounts for each of the components in the mixture is from about 0.05 weight percent to about 30 weight percent for the photogenerating component, from about 10 weight percent to about 75 weight percent for the hole transport component, and from about 10 weight percent to about 75 weight percent for the electron transport component, and wherein the total of the components is about 100 percent, and wherein the layer is dispersed in from about 10 weight percent to about 75 weight percent of a polymer binder; a member wherein the amounts for each of the components is from about 0.5 weight percent to about 5 weight percent for the photogenerating component, from about 30 weight percent to about 50 weight percent for the charge transport component, and from about 5 weight percent to about 30 weight percent for the electron transport component, and which components are contained in from about 30 weight percent to about 50 weight percent of a polymer binder, a member wherein the thickness of the single photogenerating layer mixture is from about 10 to about 40 microns, a member wherein the components are contained in a polymer binder and wherein the charge transport is comprised of hole transport molecules, a member wherein the binder is present in an amount of from about 40 to about 90 percent by weight and wherein the total of all components of photogenerating component, including the hole transport component, the binder, and the electron transport component is about 100 percent, a member wherein the titanyl phthalocyanine (TiOPC(IV)) absorbs light of a wavelength of from about 550 to about 950 nanometers, an imaging member wherein the supporting substrate is comprised of a conductive substrate comprised of a metal, an imaging member wherein the conductive substrate is aluminum, aluminized polyethylene terephthalate or titanized polyethylene terephthalate, an imaging member wherein the binder for the single photogenerating mixture layer and for the top charge transport layer when present is selected from the group consisting of polyesters, polyvinyl butyrals, polycarbonates, polystyrene-b-polyvinyl pyridine, amines, such as, N,N'-diphenyl-N,N'-bis(alkylphenyl)-1,1-biphenyl-4,4'-diamine, tri-p-tolylamine, N,N'-bis-(3,4,-dimethylphenyl)-4-biphenyl amine, N,N'-bis-(4-methylphenyl)-N,N"-bis(4-ethylphenyl)-1,1'-3,3'-dimethylbiphenyl)-4,4'-diamine, PHN, phenanthrene diamine, polyvinyl formulas, and the like, an imaging member wherein the hole transport in the photogenerating mixture and for the charge transport top layer when present comprises aryl amine molecules, an imaging member wherein the hole transport in the photogenerating mixture represented by:

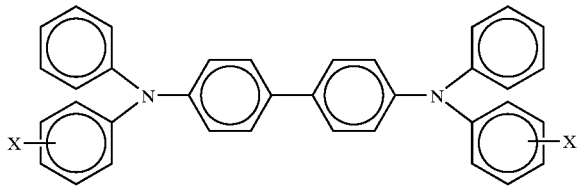

wherein X is selected from the group consisting of alkyl and halogen, an imaging member wherein alkyl contains from about 1 to about 10 carbon atoms, and wherein the top charge transport when present is an aryl amine and which amine is optionally dispersed in a highly insulating and transparent resinous binder, an imaging member wherein alkyl contains from 1 to about 5 carbon atoms, an imaging member wherein alkyl is methyl, and wherein halogen is chloride, an imaging member wherein the charge transport is comprised of N,N'-diphenyl-N,N-bis(3-methyl phenyl)-1,1'-biphenyl-4,4'-diamine dispersed in a resin binder, an imaging member wherein the electron transport component is (4-n-butoxycarbonyl-9-fluorenylidene)malononitrile, 2-methylthioethyl 9-dicyanomethylenefluorene-4-carboxylate, 2-(3-thienyl)ethyl 9-dicyanomethylenefluorene-4-carboxylate, 2-phenylthioethyl 9-dicyanomethylenefluorene-4-carboxylate, 11,11,12,12-tetracyano anthraquinodimethane or 1,3-dimethyl-10-(dicyanomethylene)-anthrone, an imaging member wherein the electron transport component is (4-n-butoxycarbonyl-9-fluorenylidene)malononitrile, an imaging member wherein the electron transport component is (4-n-butoxycarbonyl-9-fluorenylidene)malononitrile, 2-methylthioethyl 9-dicyanomethylenefluorene-4-carboxylate, 2-(3-thienyl)ethyl 9-dicyanomethylenefluorene-4-carboxylate, 2-phenylthioethyl 9-dicyanomethylenefluorene-4-carboxylate, 11,11,12,12-tetracyanoanthraquino dimethane or 1,3-dimethyl-10-(dicyanomethylene)-anthrone, an imaging member wherein the photogenerating component is a titanyl phthalocyanine (TiOPC(IV)), an imaging member wherein the photogenerating component is a titanyl phthalocyanine (TiOPC(IV)), the electron transport is (4-n-butoxy carbonyl-9-fluorenylidene)malononitrile, and the charge transport is a hole transport of N,N'-diphenyl-N,N-bis(3-methyl phenyl)-1,1'-biphenyl-4,4'-diamine molecules, a method of imaging which comprises generating an electrostatic latent image on the imaging member of the present invention, developing the latent image, and transferring the developed electrostatic image to a suitable substrate, a method of imaging wherein the imaging member is exposed to light of a wavelength of from about 500 to about 950 nanometers, an imaging apparatus containing a charging component, a development component, a transfer component, and a fixing component, and wherein the apparatus contains a photoconductive imaging member comprised of supporting substrate, and thereover a layer comprised of a titanyl phthalocyanine (TiOPC(IV)) photogenerator component, a charge transport component, and an electron transport component, a member wherein the electron transport is N,N bis(l,2-dirnethylpropyl)-l,4,5,8-naphthalenetetracarboxylic diirnide (NDTI), 1,1'-dioxo-2-(4-methylphenyl)-6-phenyl-4-(dicayanomethylidene) thiopyran(PTS), Butoxy carbonyl fluorenylidene malononitrile(BCFM), Carboxybenzyl naphthaquinone (NQN), Tetra(t-butyl)diphenoquinone(DPQ), (4-n-butoxycarbonyl-9-fluorenylidene)malononitrile, 2-methylthioethyl 9-dicyano methylenefluorene-4-carboxylate, 2-(3-thienyl)ethyl 9-dicyano methylenefluorene-4-carboxylate, 2-phenylthioethyl 9-dicyano methylenefluorene-4-carboxylate, 11,11,12,12-tetracyano anthraquino dimethane or 1,3-dimethyl-10-(dicyanomethylene)-anthrone, and the like, an imaging member further containing an adhesive layer and a hole blocking layer, an imaging member wherein the blocking layer is contained as a coating on a substrate and wherein the adhesive layer is coated on the blocking layer, and photoconductive imaging members comprised of an optional supporting substrate, a single layer comprised of a photogenerating layer of a titanyl phthalocyanine (TiOPC(IV)), and further BZP perylene, which BZP is preferably comprised a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f') diisoquinoline-10,21-dione, reference U.S. Pat. No. 4,587,189, the disclosure of which is totally incorporated herein by reference, charge transport molecules, reference for example, U.S. Pat. No. 4,295,990, the disclosure of which is totally incorporated herein by reference, electron transport components, and a binder polymer. In embodiments, the charge transport molecules for the photogenerating mixture layer are aryl amines, and the electron transport is a fluorenylidene, such as, (4-n-butoxycarbonyl-9-fluorenylidene)malononitrile, reference U.S. Pat. No. 4,474,865, the disclosure of which is totally incorporated herein by reference.

The positively charged, or negatively charged photoresponsive imaging member of the present invention in embodiments is comprised, in the following sequence, of a supporting substrate, a single layer thereover comprised of a photogenerator layer comprised of a titanyl phthalocyanine (TiOPC(IV)), charge transport molecules of N,N'-diphenyl-N,N'-bis(3-methyl phenyl)-1,1'-biphenyl-4,4'-diamine, and electron transport components of (4-n-butoxycarbonyl-9-fluorenylidene) malononitrile all dispersed in a suitable polymer binder, such as, a polycarbonate binder.

An example of the photogenerating components, especially pigments are titanyl phthalocyanine (TiOPC(IV))s, and as an optional second pigment metal free phthalocyanines, perylenes, vanadyl phthalocyanine, chloroindium phthalocyanine, and benzimidazole perylene, which is preferably a mixture of, for example, 60/40, 50/50, 40/60, bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f') diisoquinoline-10,21-dione, and the like, inclusive of appropriate known photogenerating components. The photogenerating component, which is preferably comprised of a titanyl phthalocyanine (TiOPC(IV)), is in embodiments comprised of, for example, about 50 weight percent of the titanyl phthalocyanine and about 50 weight percent of a resin binder.

Charge transport components that may be selected for the photogenerating mixture include, for example, arylamines, and more specifically, N,N'-diphenyl-N,N'-bis(alkylphenyl)-1,1-biphenyl-4,4-diamine(MTBD), N,N'-diphenyl-N,N'-bis (alkylphenyl)-1,1-terphenyl-4,4'-diamine(terphenyl-TBD), Tri-p-tolylamine(TTA), 1,l-bis(di-4-tolylarninophenyl) cyclohexane(TAPC), N,N'-his-(3,4-dimethylphenyl)-4-hiphenyl amine, N,N',bis-(4-methylphenyl)-N,N'-bis(4-ethylphenyl)-l, 1, '-3,3'-dimethylbiphenyl)-4,4-diamine, N,N-bis(2-methyl-2-phenylvinyl)- N,N'-diphenylbenzidine, phenanthrene diamine, 9-9-bis(2-cyanoethyl)-2,7-bis (phenyl-m-tolylamino)fluorene, tritolylamine, hydrazone, N,N'-bis(3,4 dimethylphenyl)-N"(1-biphenyl) amine, and the like, dispersed in a polycarbonate binder.

Specific examples of electron transport molecules are (4-n-butoxycarbonyl-9-fluorenylidene)malononitrile, 2-methylthioethyl 9-dicyano methylenefluorene-4-carboxylate, 2-(3-thienyl)ethyl 9-dicyano methylenefluorene-4-carboxylate, 2-phenylthioethyl 9-dicyano methylenefluorene-4-carboxylate, 11,11,12,12-tetracyano anthraquino dimethane, 1,3-dimethyl-10-(dicyanomethylene)-anthrone, and the like.

The photogenerating pigment can be present in various amounts, such as, for example, from about 0.05 weight percent to about 30 weight percent, and more specifically, from about 0.05 weight percent to about 5 weight percent. Charge transport components, such as, hole transport molecules, can be present in various effective amounts, such as, in an amount of from about 10 weight percent to about 75 weight percent and preferably in an amount of from about 30 weight percent to about 50 weight percent, the electron transport molecule can be present in various amounts, such as, in an amount of from about 10 weight percent to about 75 weight percent, and more specifically, in an amount of from about 5 weight percent to about 30 weight percent, and the polymer binder can be present in an amount of from about 10 weight percent to about 75 weight percent, and more specifically, in an amount of from about 30 weight percent to about 50 weight percent. The thickness of the single photogenerating layer can be, for example, from about 5 microns to about 60 microns, and more specifically, from about 10 microns to about 30 microns.

The photogenerating pigment primarily functions to absorb the incident radiation and generates electrons and holes. In a negatively charged imaging member, holes are transported to the photoconductive surface to neutralize negative charge and electrons are transported to the substrate to permit photodischarge. In a positively charged imaging member, electrons are transported to the surface where they neutralize the positive charges and holes are transported to the substrate to enable photodischarge. By selecting the appropriate amounts of charge and electron transport molecules, ambipolar transport can be obtained, that is, the imaging member can be charged negatively or positively, and the member can also be photodischarged.

The photoconductive imaging members can be prepared by a number of methods, such as, the coating of the components from a dispersion, and more specifically, as illustrated herein. Thus, the photoresponsive imaging members of the present invention can in embodiments be prepared by a number of known methods, the process parameters being dependent, for example, on the member desired. The photogenerating, electron transport, and charge transport components of the imaging members can be coated as solutions or dispersions onto a selective substrate by the use of a spray coater, dip coater, extrusion coater, roller coater, wire-bar coater, slot coater, doctor blade coater, gravure coater, and the like, and dried at from about 40 degrees celsius to about 200 degrees celsius for a suitable period of time, such as, from about 10 minutes to about 10 hours, under stationary conditions or in an air flow. The coating can be accomplished to provide a final coating thickness of from about 5 to about 40 microns after drying.

Imaging members of the present invention are useful in various electrostatographic imaging and printing systems, particularly those conventionally known as xerographic processes. Specifically, the imaging members of the present invention are useful in xerographic imaging processes wherein the photogenerating component absorbs light of a wavelength of from about 550 to about 950 nanometers, and preferably from about 700 to about 850 nanometers.

Moreover, the imaging members of the present invention can be selected for electronic printing processes with gallium arsenide diode lasers, light emitting diode (LED) arrays, which typically function at wavelengths of from about 660 to about 830 nanometers, and for color systems inclusive of color printers, such as those in communication with a computer. Thus, included within the scope of the present invention are methods of imaging and printing with the photoresponsive or photoconductive members illustrated herein. These methods generally involve the formation of an electrostatic latent image on the imaging member, followed by developing the image with a toner composition comprised, for example, of thermoplastic resin, colorant, such as, pigment, charge additive, and surface additives, reference U.S. Pat. Nos. 4,560,635, 4,298,697 and 4,338,390, the disclosures of which are totally incorporated herein by reference, subsequently transferring the image to a suitable substrate, and permanently affixing, for example by heat, the image thereto. In those environments wherein the member is to be used in a printing mode, the imaging method is similar with the exception that the exposure step can be accomplished with a laser device or image bar.

The electron transport as indicated here is more specifically a tetra(t-butyl)diphenolquinone represented by:

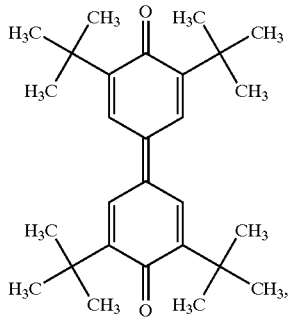

and mixtures thereof, and (4-n-butoxycarbonyl-9-fluorenylidene)malononitrile represented by:

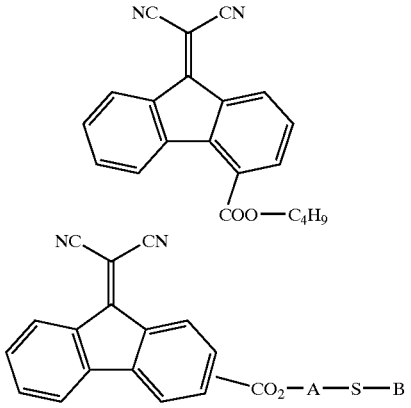

wherein S is sulfur, A is a spacer moiety or group selected from the group consisting of alkylene groups, wherein alkylene can contain, for example, from about 1 to about 14 carbon atoms, and arylene groups, which can contain from about 7 to about 36 carbon atoms, and B is selected from the group consisting of alkyl groups, and aryl groups. Specific examples include; 2-methylthioethyl 9-dicyanomethylenefluorene-4-carboxylate, 2-(3-thienyl) ethyl 9-dicyano methylenefluorene-4-carboxylate, a 2-phenylthioethyl 9-dicyano methylenefluorene-4-carboxylate, and the like. The electron transporting materials can contribute to the ambipolar properties of the final photoreceptor and also provide the desired rheology and freedom from agglomeration during the preparation and application of the coating dispersion. Moreover, these electron transporting materials ensure substantial discharge of the photoreceptor during imagewise exposure to form the electrostatic latent image.

Polymer binder examples include components, as illustrated, for example, in U.S. Pat. No. 3,121,006, the disclosure of which is totally incorporated herein by reference. Specific examples of polymer binder materials include; polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins with a molecular weight of from about 20,000 to about 100,000, and more specifically, with a weight average molecular weight, of from about 50,000 to about 100,000.

The combined weight of the arylamine hole transport molecules and the electron transport molecules in the electrophotographic photoconductive insulating layer is between about 35 percent and about 65 percent by weight, based on the total weight of the electrophotographic photoconductive insulating layer after drying. The film forming polymer binder can be present in an amount of from about 10 weight percent to about 75 weight percent, and in embodiments in an amount of from about 30 weight percent to about 60 weight percent, based on the total weight of the electrophotographic photoconductive insulating layer after drying. The hole transport and electron transport molecules are dissolved or molecularly dispersed in the film forming binder. The expression "molecularly dispersed", refers, for example, to dispersion on a molecular scale. The above materials can be processed into a dispersion useful for coating by any of the conventional methods used to prepare such materials. These methods include; ball milling, media milling in both vertical or horizontal bead mills, paint shaking the materials with suitable grinding media, and the like, to achieve a suitable dispersion.

EXAMPLE I

A pigment dispersion was prepared by roll milling 5 grams of titanyl phthalocyanine (TiOPC(IV)) pigment particles and 5 grams of poly(4,4'-diphenyl-1,1'-cyclohexane carbonate) at from about 10 to about 11 percent solids in toluene with 300 grams of 3 millimeter diameter steel balls for about 24 to about 72 hours.

Separately, 18.8 grams of poly(4,4'-diphenyl-1,1'-cyclohexane carbonate were weighed and mixed together with 12.2 grams of N,N'-diphenyl-N,N'-bis(methylphenyl)-1,1-biphenyl-4,4'-diamine(TPD), 8.2 grams of N,N'-bis(1,2-dimethylpropyl)-1,4,5,8-naphthalenetetracarboxylic diimide (NTDI), 77.4 grams of tetrahydrofuran and 22.1 grams of monochlorobenzene. The resulting mixture was rolled in a glass bottle until the solids were dissolved, then 6.65 grams of the above pigment dispersion were added to form a dispersion containing the titanyl phthalocyanine (TiOPC (IV)), poly(4,4'-diphenyl-1,1'-cyclohexane carbonate), N,N'-diphenyl-N,N'-bis(methylphenyl)-1,1-biphenyl-4,4'-diamine, and N,N'-bis(1,2dimethylpropyl)-1,4,5,8-naphthalenetetracarboxylic diimide in a solids weight ratio of (2:48:30:20) and a total solid contents of about 24 percent, and rolled for further mixing (without milling beads). Various dispersions were prepared at total solids contents ranging from about 22 percent to 25 percent. More than 26 dispersions were prepared at these ratios. These dispersions were applied by dip coating to aluminum drums having a length of 24 to 36 centimeters and a diameter of 30 millimeters. For the 27 weight percent dispersion, a dip coating rate of from about 110 to about 140 millimeters/minute provided from about 24 to about 30 micrometers thick single photoconductive insulating layers on the drums after drying. Viscosities of the dispersions are of from about 250 to about 500 centipoises for a solids content of from about 22 to about 24 percent. Thickness of the resulting dried layers were determined by Eddy current measurement and by transmission electron microscopy.

EXAMPLE II

The above devices were electrically tested with a cyclic scanner set to go through 140 cycles, where each charge-expose-erase cycle was followed by a dark cycle and the light intensity was incrementally increased to produce a photoinduced discharge curve from which the photosensitivity was measured. The scanner was equipped with a scorotron set to a constant voltage charging at various surface potentials. The devices of Example I were tested at surface potentials of 350, 500, 650, and 800 volts with the exposure light intensity incrementally increased by regulating a series of neutral density filters. The exposure light source was a 780 nanometer light emitting diode. The drum was rotated at a speed of 61 revolutions per minute to produce a surface speed of 25 inches per second or a cycle time of 0.984 second. The entire xerographic simulation was carried out in an environmentally controlled light tight chamber at ambient conditions, i.e. about forty percent relative humidity and 22 degrees Celsius. Four photoinduced discharge characteristics (PIDC) curves were obtained from the four different pre-exposed surface potentials, and the data were interpolated to a PIDC curve at an initial surface potential of 600 volts, as shown in Table 1. Several representative compositions of titanyl phthalocyanine single layer devices are shown in Table 2.

Table 1. TiOPC(IV)-based single layer devices. Solvent: THF:MCB (88:12). Solid content: 23.4%. Comparative results of single-layer devices based on other pigments are also shown (Note: different solvent systems may be used). TPD: N,N'-diphenyl-N,N'-bis(methylphenyl)-1,1-biphenyl-4,4'-diamine. NTDI: N,N'-bis(1,2-dimethylpropyl)-1,4,5,8-naphthalenetetracarboxylic diimide. L/ϵ: dielectric thickness. $V_0$: initial surface potential. dV/dX: slope of the PIDC of initial surface potential versus exposure energy. Vdepletion: voltage depletion of an imaging member. $V_R$: residual voltage.

TABLE 1

| Device | TiOPC (wt %) | PCZ500: (weight %) | HT: | ET | Milling Solvent | Thickness (μm) | L/ϵ | $V_0$ | dV/dX (V/ergs/cm$^2$) | Dark Decay Rate V/s (20 nC/cm$^2$; 0.1–0.3 s) | $V_{depletion}$ | $V_R$ |
|---|---|---|---|---|---|---|---|---|---|---|---|---|
| 1 | 1.4 | 48.6 | TPD 32 | NTDI 18 | Tol | 30 | 8.6 | 600 | 312 | 112 | 34 | 60 |
| 2 | 2 | 48 | TPD 32 | NTDI 18 | Tol | 32 | 8.4 | 600 | 340 | 147 | 48 | 66 |
| 3 | 1.4 | 48.6 | TPD 32 | NTDI 18 | DCM | 28.2 | 7.9 | 600 | 300 | 124 | 44 | 53 |
| 4 | 2 | 48 | TPD 32 | NTDI 18 | DCM | 33 | 8.3 | 600 | 330 | 160 | 54 | 56 |
| 5 | HOGaPC2 | 48 | TPD 30 | NTDI 20 | THF | 29 | 7.8 | 600 | 354 | 140 | 65 | 45 |
| 6 | x-H,PC2 | 48 | TPD 30 | NTDI 20 | THF | 30 | 8.2 | 600 | 160 | 60 | 30 | 44 |

TiOPC(IV)-based single layer devices. Solvent: THF:MCB (88:12). Solid content: 23.4%. Comparative results of single-layer devices based on other pigments are also shown (Note: different solvent systems may be used). TPD: N,N'-diphenyl-N,N'-bis(methylphenyl)-1,1-biphenyl-4,4'-diamine. NTDI: N,N'-bis(1,2-dimethylpropyl)-1,4,5,8-naphthalenetetracarboxylic diimide. L/ϵ: dielectric thickness. $V_0$: initial surface potential. dV/dX: slope of the PIDC of initial surface potential versus exposure energy. Vdepletion: voltage depletion of an imaging member. $V_R$: residual voltage.

TABLE 2

Representative TiOPC-based Single Layer Photoreceptor Formulations

| Formulation | TiOPC (wt %) | PCZ (wt %) | Hole Transport (HT) (wt %) HT1 | HT2 | Electron Transport (ET) (wt %) ET1 | ET2 | Solid wt % | Solvent (in weight) |
|---|---|---|---|---|---|---|---|---|
| 1 | 2 | 48 | mTBD (30) | | NTDI (20) | | 24.0 | DCM:Tol (60:40) |
| 2 | 2 | 48 | mTBD (30) | | NTDI (3.5) | NQN (16.5) | 23.8 | DCM:Tol (60:40) |
| 3 | 3 | 47 | mTBD (30) | | NTDI (20) | | 24.2 | DCM:Tol (60:40) |
| 4 | 3 | 47 | mTBD (30) | | NTDI (3.5) | NQN (16.5) | 24.0 | DCM:Tol (60:40) |
| 5 | 2 | 48 | TTA (30) | | NTDI (20) | | 23.8 | DCM:Tol (60:40) |
| 6 | 2 | 48 | TTA (30) | | NTDI (3.5) | NQN (16.5) | 23.7 | DCM:Tol (60:40) |
| 7 | 3 | 47 | TTA (30) | | NTDI (20) | | 24.0 | DCM:Tol (60:40) |

TABLE 2-continued

Representative TiOPC-based Single Layer Photoreceptor Formulations

| Formulation | TiOPC (wt %) | | Hole Transport (HT) (wt %) HT1 | HT2 | Electron Transport (ET) (wt %) ET1 | ET2 | Solid wt % | Solvent (in weight) |
|---|---|---|---|---|---|---|---|---|
| 8 | 3 | 47 | TTA (30) | | NTDI (3.5) | NQN (16.5) | 23.8 | DCM:Tol (60:40) |
| 9 | 2 | 48 | Ae-18 (15) | AB-16 (15) | NTDI (20) | | 23.8 | THF:Tol (75:25) |
| 10 | 3 | 47 | Ae-18 (15) | AB-16 (15) | NTDI (3.5) | NQN (16.5) | 23.4 | THF:Tol (75:25) |
| 11 | 3 | 47 | ENA (20) | TTA (10) | NTDI (20) | | 23.8 | THF:Tol (75:25) |
| 12 | 2 | 46 | ENA (22) | TTA (10) | NTDI (20) | | 23.6 | THF:Tol (75:25) |
| 13 | 2 | 48 | ENA (30) | | PTS (20) | | 24.2 | THF:Tol (75:25) |
| 14 | 2 | 48 | ENA (32) | | NTDI (20) | | 23.2 | DCM:MCB (70:30) |
| 15 | 4 | 46 | Ae-18 (17) | TTA (17) | NTDI (20) | | 23.6 | DCM:MCB (70:30) |
| 16 | 2 | 48 | Ae-18 (17) | TTA (17) | PTS (20) | | 23.8 | DCM:MCB (70:30) |
| 17 | 4 | 46 | Ae-18 (17) | AB-16 (17) | PTS (20) | | 23.8 | DCM:MCB (70:30) |
| 18 | 3 | 46 | ENA (22) | mTBD (10) | DPQ (3.5) | NQN (16.5) | 23.4 | DCM:MCB (70:30) |
| 19 | 3 | 47 | mTBD (30) | | DPQ (3.5) | NQN (16.5) | 23.8 | DCM:MCB (70:30) |
| 20 | 2 | 46 | mTBD (30) | | DPQ (3.5) | NQN (16.5) | 23.6 | DCM:MCB (70:30) |
| 21 | 2 | 48 | TTA (30) | | DPQ (3.5) | NQN (16.5) | 24.2 | DCM:MCB (70:30) |
| 22 | 2 | 48 | TTA (30) | | DPQ (3.5) | NQN (16.5) | 22.2 | DCM:MCB (70:30) |
| 23 | 4 | 46 | mTBD (32) | | NTDI (2.5) | PTS (15.5) | 23.6 | THF:MCB (90:10) |
| 24 | 2 | 48 | TTA (30) | | NTDI (2.5) | PTS (15.5) | 23.5 | THF:MCB (85:15) |
| 25 | 4 | 46 | ENA (32) | | NTDI (2.5) | NQN (15.5) | 23.8 | THF:MCB (90:10) |
| | | PCA (wt %) | | | | | | |
| 26 | 2 | 48 | mTBD (30) | | NTDI (20) | | 24.0 | DCM:Tol (60:40) |
| 27 | 2 | 48 | mTBD (30) | | NTDI (3.5) | NQN (16.5) | 23.8 | DCM:Tol (60:40) |
| 28 | 3 | 47 | mTBD (30) | | NTDI (20) | | 24.2 | DCM:Tol (60:40) |
| 29 | 3 | 47 | mTBD (30) | | NTDI (3.5) | NQN (16.5) | 24.0 | DCM:Tol (60:40) |
| 30 | 2 | 48 | TTA (30) | | NTDI (20) | | 23.8 | DCM:Tol (60:40) |
| 31 | 2 | 48 | TTA (30) | | NTDI (3.5) | NQN (16.5) | 23.7 | DCM:Tol (60:40) |
| 32 | 3 | 47 | TTA (30) | | NTDI (20) | | 24.0 | DCM:Tol (60:40) |
| 33 | 3 | 47 | TTA (30) | | NTDI (3.5) | NQN (16.5) | 23.8 | DCM:Tol (60:40) |
| 34 | 2 | 48 | Ae-18 (15) | AB-16 (15) | NTDI (20) | | 23.8 | THF:Tol (75:25) |
| 35 | 3 | 47 | Ae-18 (15) | AB-16 (15) | NTDI (3.5) | NQN (16.5) | 23.4 | THF:Tol (75:25) |
| 36 | 3 | 47 | ENA (20) | TTA (10) | NTDI (20) | | 23.8 | THF:Tol (75:25) |
| 37 | 2 | 46 | ENA (22) | TTA (10) | NTDI (20) | | 23.6 | THF:Tol (75:25) |
| 38 | 2 | 48 | ENA (30) | | PTS (20) | | 24.2 | THF:Tol (75:25) |
| 39 | 2 | 48 | ENA (32) | | NTDI (20) | | 23.2 | DCM:MCB (70:30) |
| 40 | 4 | 46 | Ae-18 (17) | TTA (17) | NTDI (20) | | 23.6 | DCM:MCB (70:30) |
| 41 | 2 | 48 | Ae-18 (17) | TTA (17) | PTS (20) | | 23.8 | DCM:MCB (70:30) |
| 42 | 4 | 46 | Ae-18 (17) | AB-16 (17) | PTS (20) | | 23.8 | DCM:MCB (70:30) |
| 43 | 3 | 46 | ENA (22) | mTBD (10) | DPQ (3.5) | NQN (16.5) | 23.4 | DCM:MCB (70:30) |
| 44 | 3 | 47 | mTBD (30) | | DPQ (3.5) | NQN (16.5) | 23.8 | DCM:MCB (70:30) |
| 45 | 2 | 46 | mTBD (30) | | DPQ (3.5) | NQN (16.5) | 23.6 | DCM:MCB (70:30) |
| 46 | 2 | 48 | TTA (30) | | DPQ (3.5) | NQN (16.5) | 24.2 | DCM:MCB (70:30) |
| 47 | 2 | 48 | TTA (30) | | DPQ (3.5) | NQN (16.5) | 22.2 | DCM:MCB (70:30) |
| 48 | 4 | 46 | mTBD (32) | | NTDI (2.5) | PTS (15.5) | 23.6 | THF:MCB (90:10) |
| 49 | 2 | 48 | TTA (30) | | NTDI (2.5) | PTS (15.5) | 23.5 | THF:MCB (85:15) |
| 50 | 4 | 46 | ENA (32) | | NTDI (2.5) | NQN (15.5) | 23.8 | THF:MCB (90:10) |

Other embodiments and modifications of the present invention may occur to those skilled in the art subsequent to a review of the information presented herein, these embodiments and modifications, equivalents thereof, substantial equivalents thereof, or similar equivalents thereof are also included within the scope of this invention.

What is claimed is:

1. A photoconductive imaging member comprised of a supporting substrate, and thereover a single layer comprised of a mixture of a photogenerating component, a hole transport component, an electron transport component, and a polymer binder, wherein the photogenerating component is comprised of titanyl phthalocyanine and hydroxygallium phthalocyanine, and wherein the electron transport component comprises at least one component selected from the group consisting of:

a) a carboxlfluorenone malonitrile (CFM) derivative represented by:

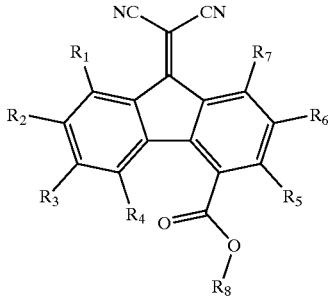

wherein each R is independently selected from the group consisting of hydrogen, alkyl having 1 to 40 carbon atoms, alkoxy having 1 to 40 carbon atoms, phenyl, higher aromatic such as naphthalene and anthracene, alkylphenyl having 6 to 40 carbons, and aryl having 6 to 30 and halogen, and b) a nitrated fluoreneone derivative represented by:

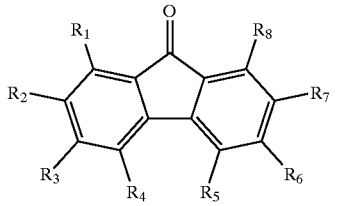

wherein each R is independently selected from the group consisting of hydrogen, alkyl having 1 to 40 carbon atoms, alkoxy having 1 to 40 carbon atoms, phenyl, substituted phenyl, higher aromatic such as naphthalene and anthracene, alkylphenyl having 6 to 40 carbons, alkoxyphenyl having 6 to 40 carbons, aryl having 6 to 30 carbons, substituted aryl having 6 to 30 carbons and halogen, and at least 2 R groups are chosen to be nitro groups.

2. An imaging member in accordance with claim 1, wherein said single layer is of a thickness is from about 5 to about 60 microns.

3. An imaging member in accordance with claim 2, wherein the thickness of said single layer is from about 3 to about 50 microns.

4. An imaging member in accordance with claim 1, wherein the amounts for each of said components in said single layer is from about 0.05 weight percent to about 30 weight percent for the photogenerating component, from about 10 weight percent to about 75 weight percent for the hole transport component, and from about 10 weight percent to about 75 weight percent for the electron transport component, and wherein the total of said components is about 100 percent, and wherein said layer components are optionally dispersed in from about 10 weight percent to about 75 weight percent of said polymer binder, and wherein said layer is of a thickness of from about 5 to about 15 microns.

5. An imaging member in accordance with claim 1, wherein the amounts for each of said components in the single layer is from about 0.5 weight percent to about 5 weight percent for the photogenerating component; from about 30 weight percent to about 50 weight percent for the hole transport component; and from about 5 weight percent to about 35 weight percent for the electron transport component; and which components are contained in from about 30 weight percent to about 50 weight percent of a polymer binder.

6. An imaging member in accordance with claim 1, wherein the binder is selected from the group consisting of polyesters, polyvinyl butyrals, polycarbonates, polystyrene-b-polyvinyl pyridine, and polyvinyl alcohols.

7. An imaging member in accordance with claim 1, wherein said binder is present in an amount of from about 50 to about 90 percent by weight, and wherein the total of all components of said photogenerating component, said hole transport component, said binder, and said electron transport component is about 100 percent.

8. An imaging member in accordance with claim 1 wherein said photogenerating component absorbs light of a wavelength of from about 370 to about 950 nanometers.

9. An imaging member in accordance with claim 1 wherein the supporting substrate is comprised of a conductive substrate comprised of a metal.

10. An imaging member in accordance with claim 9 wherein the conductive substrate is aluminum, aluminized polyethylene terephthalate or titanized polyethylene terephthalate.

11. An imaging member in accordance with claim 1, wherein said charge transporting component or components is comprised of molecules represented by:

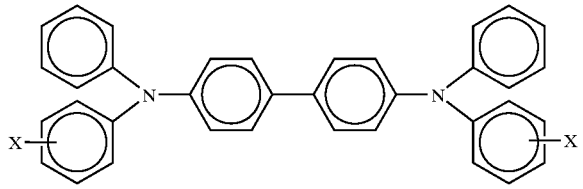

wherein X is selected from the group consisting of alkyl and halogen.

12. An imaging member in accordance with claim 11, wherein said alkyl contains from about 1 to about 10 carbon atoms.

13. An imaging member in accordance with claim 11, wherein said hole transport component is comprised of molecules of N,N'-diphenyl-N,N-bis(3-methyl phenyl)-1,1'-biphenyl-4,4'-diamine.

14. An imaging member in accordance with claim 11, wherein the polymer binder is a polycarbonate or polystyrene-b-polyvinyl pyridine in which other single layer components are dispersed.

15. An imaging member in accordance with claim 1, wherein the electron transport component comprises a carboxlfluorenone malonitrile (CFM) derivative represented by:

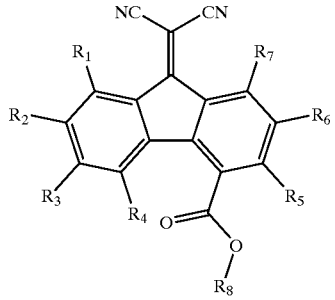

wherein each R is independently selected from the group consisting of hydrogen, alkyl having 1 to 40 carbon atoms, alkoxy having 1 to 40 carbon atoms, phenyl, higher aromatic such as naphthalene and anthracene, alkylphenyl having 6 to 40 carbons, aryl having 6 to 30 and halogen.

16. An imaging member in accordance with claim 1, wherein the electron transport component comprises a nitrated fluoreneone derivative represented by:

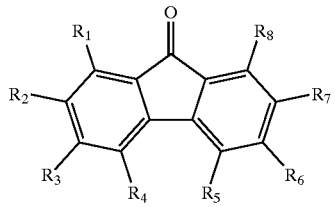

wherein each R is independently selected from the group consisting of hydrogen, alkyl having 1 to 40 carbon atoms, alkoxy having 1 to 40 carbon atoms, phenyl, substituted phenyl, higher aromatic such as naphthalene and anthracene, alkylphenyl having 6 to 40 carbons, alkoxyphenyl having 6 to 40 carbons, aryl having 6 to 30 carbons, substituted aryl having 6 to 30 carbons and halogen, and at least 2 R groups are chosen to be nitro groups.

17. An imaging member comprising, in sequence, a supporting layer, and a single electrophotographic photoconductive insulating layer, the insulating layer comprising particles comprising a titanyl phthalocyanine (TiOPC(IV)) photogenerating pigment dispersed in a matrix comprising an arylamine hole transporter, and at least one electron transporter selected from the group consisting of:

a) a carboxlfluorenone malonitrile (CFM) derivative represented by:

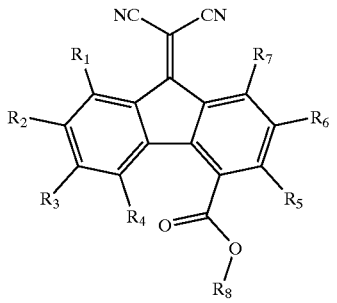

wherein each R is independently selected from the group consisting of hydrogen, alkyl having 1 to 40 carbon atoms, alkoxy having 1 to 40 carbon atoms, phenyl, higher aromatic such as naphthalene and anthracene, alkylphenyl having 6 to 40 carbons, and aryl having 6 to 30 and halogen, and b) a nitrated fluoreneone derivative represented by:

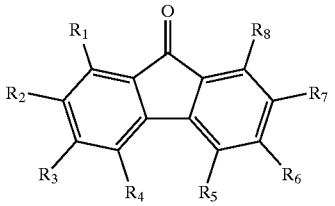

wherein each R is independently selected from the group consisting of hydrogen, alkyl having 1 to 40 carbon atoms, alkoxy having 1 to 40 carbon atoms, phenyl, substituted phenyl, higher aromatic such as naphthalene and anthracene, alkylphenyl having 6 to 40 carbons, alkoxyphenyl having 6 to 40 carbons, aryl having 6 to 30 carbons, substituted aryl having 6 to 30 carbons and halogen, and at least 2 R groups are chosen to be nitro groups.

18. An imaging member in accordance with claim 17 wherein the arylamine is N,N'-diphenyl-N,N'-bis(3-methylphenyl)-[1,1'-biphenyl]-4,4'-diamine and the film forming binder is a polycarbonate.

19. An imaging member in accordance with claim 17 wherein the hole transport comprises aryl amine molecules represented by:

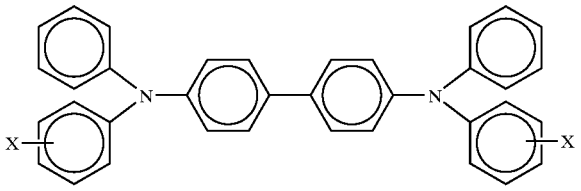

wherein X is selected from the group consisting of alkyl and halogen.

* * * * *